US008198500B2

(12) United States Patent
Elomari et al.

(10) Patent No.: US 8,198,500 B2
(45) Date of Patent: Jun. 12, 2012

(54) PROCESS TO MAKE BASE OIL FROM FISCHER-TROPSCH CONDENSATE BY CONCURRENT OLIGOMERIZATION AND ALKYLATION

(75) Inventors: Saleh Elomari, Fairfield, CA (US); Russell Roland Krug, Novato, CA (US); Stephen Joseph Miller, San Francisco, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 13/289,265

(22) Filed: Nov. 4, 2011

(65) Prior Publication Data

US 2012/0053380 A1 Mar. 1, 2012

Related U.S. Application Data

(60) Division of application No. 12/498,262, filed on Jul. 6, 2009, now Pat. No. 8,119,851, which is a continuation-in-part of application No. 11/316,154, filed on Dec. 20, 2005, now Pat. No. 7,572,943, and a continuation-in-part of application No. 11/316,155, filed on Dec. 20, 2005, now Pat. No. 7,572,944, and a continuation-in-part of application No. 11/316,157, filed on Dec. 20, 2005, now Pat. No. 7,569,740, and a continuation-in-part of application No. 11/316,628, filed on Dec. 20, 2005, now Pat. No. 7,576,252, and a continuation-in-part of application No. 12/261,388, filed on Oct. 30, 2008, now Pat. No. 8,115,040.

(51) Int. Cl.
*C07C 2/26* (2006.01)
*C07C 2/58* (2006.01)

(52) U.S. Cl. ..... 585/722; 585/727; 585/728; 585/521; 585/522; 585/527

(58) Field of Classification Search ..... 585/722, 585/727, 728, 521, 522, 527
See application file for complete search history.

(56) References Cited

U.S. PATENT DOCUMENTS

| | | | |
|---|---|---|---|
| 5,750,455 | A | 5/1998 | Chauvin et al. |
| 6,028,024 | A | 2/2000 | Hirschauer et al. |
| 6,395,948 | B1 | 5/2002 | Hope et al. |
| 6,497,812 | B1 | 12/2002 | Schinski |
| 6,750,455 | B2 | 6/2004 | Lo et al. |
| 7,045,055 | B2 | 5/2006 | Ziemer et al. |
| 2001/0001804 | A1 | 5/2001 | Skledar et al. |
| 2004/0267071 | A1 | 12/2004 | Harris et al. |
| 2007/0249883 | A1 | 10/2007 | Dakka et al. |
| 2009/0131731 | A1 | 5/2009 | Willams |

FOREIGN PATENT DOCUMENTS

| | | |
|---|---|---|
| EP | 791643 | 8/2007 |

OTHER PUBLICATIONS

PCT/US06/46907, Written Opinion of the International Searching Authority, 3 pages, mail dated Sep. 13, 2007.

*Primary Examiner* — Thuan Dinh Dang
(74) *Attorney, Agent, or Firm* — Susan M. Abernathy

(57) ABSTRACT

A process comprising contacting an olefin feed from a Fischer-Tropsch condensate with an isoparaffin, an acidic chloroaluminate ionic liquid catalyst, and a Brönsted acid; whereby a base oil is produced by concurrent oligomerization and alkylation.

10 Claims, No Drawings

PROCESS TO MAKE BASE OIL FROM FISCHER-TROPSCH CONDENSATE BY CONCURRENT OLIGOMERIZATION AND ALKYLATION

This application is a divisional of U.S. patent application Ser. No. 12/498,262, filed Jul. 6, 2009, now U.S. Pat. No. 8,119,851, herein incorporated in its entirety. This application also claims priority as a continuation in part to U.S. patent applications Ser. No. 11/316,154, filed Dec. 20, 2005, now U.S. Pat. No. 7,572,943; U.S. patent application Ser. No. 11/316,155, filed Dec. 20, 2005, now U.S. Pat. No. 7,572,944; U.S. patent application Ser. No. 11/316,157, filed Dec. 20, 2005, now U.S. Pat. No. 7,569,740; U.S. patent application Ser. No. 11/316,628, filed Dec. 20, 2005, now U.S. Pat. No. 7,576,252; U.S. patent application Ser. No. 12/261,388, filed Oct. 30, 2008 now U.S. Pat. No. 8,115,040; and herein incorporated in their entireties. This application also claims priority to U.S. patent application Ser. No. 12/498,254, filed Jul. 6, 2009, now U.S. Pat. No. 7,723,556; and herein incorporated in its entirety.

BACKGROUND

Potentially, Ionic Liquid catalyst systems can be used for the oligomerization of olefins such as normal alpha olefins to make olefin oligomers. A Patent that describes the use of an ionic liquid catalyst to make polyalphaolefins is U.S. Pat. No. 6,395,948 which is incorporated herein by reference in its entirety. A published application that discloses a process for oligomerization of alpha olefins in ionic liquids is EP 791, 643.

Ionic Liquid catalyst systems have also been used for isoparaffin—olefin alkylation reactions. Patents that disclose a process for the alkylation of isoparaffins by olefins are U.S. Pat. Nos. 5,750,455 and 6,028,024.

It would be desirable to have a process for making a lubricant or lubricant starting materials with low degree of unsaturation (low concentration of double bonds) thus reducing the need for exhaustive hydrogenation while preferably maintaining or more preferably increasing the average molecular weight and branching of the material while also increasing the lubricant properties of the product.

SUMMARY

We provide a process for making a base oil, comprising: a)selecting an olefin feed from a Fischer-Tropsch condensate; b)oligomerizing the olefin feed in an ionic liquid oligomerization zone comprising an acidic ionic liquid catalyst at a set of oligomerization conditions to form an oligomer; and c)alkylating the oligomer in the presence of an isoparaffin, in an ionic liquid alkylation zone comprising an acidic ionic liquid catalyst, at a set of alkylation conditions to form an alkylated oligomeric product having: a kinematic viscosity at 100° C. of 6.9 $mm^2/s$ or greater, a VI of at least 134, and a Bromine Number of less than 4.

We also provide a process for making a base oil, comprising: a) oligomerizing at least one olefin in an olefin feed from a Fischer-Tropsch condensate, wherein an olefin fraction in the olefin feed comprises greater than 50 wt % C4+ olefins, to produce an oligomerized product; and b) alkylating the oligomerized product in an ionic liquid alkylation zone, at a set of alkylation conditions, to form an alkylated oligomeric product having a kinematic viscosity at 100° C. of 6.9 $mm^2/s$ or greater and a VI of at least 134.

We also provide a process for making a base oil, comprising: contacting an olefin feed from a Fischer-Tropsch condensate with an isoparaffin, an acidic chloroaluminate ionic liquid catalyst, and a Brönsted acid; whereby a base oil is produced by concurrent oligomerization and alkylation of the olefin feed.

DETAILED DESCRIPTION

We provide a novel process for the production of lubricant or lubricant components by the acid catalyzed oligomerization of olefins and alkylation with isoparaffins in ionic liquid medium to form a product having greatly reduced olefin content and improved quality. We found that oligomerization of an olefin and alkylation of an olefin and/or its oligomers with an isoparaffin can be performed together in a single reaction zone or alternatively in two separate zones. The alkylated or partially alkylated oligomer stream that results has very desirable properties for use as a lubricant or lubricant blendstock.

Oligomerization of two or more olefin molecules results in the formation of an olefin oligomer that generally comprises a long branched chain molecule with one remaining double bond. We provide a novel way to reduce the concentration of double bonds and at the same time enhance the quality of the desired fuel or lubricant. In some embodiments, the processes reduce the amount of hydrofinishing that is needed to achieve a desired product with low olefin concentration. The olefin concentration can be determined by Bromine Index or Bromine Number. Bromine Number can be determined by test ASTM D 1159. Bromine Index can be determined by ASTM D 2710. Test methods D 1159 and ASTM D 2710 are incorporated herein by reference in their entirety. Bromine Index is effectively the number of milligrams of Bromine ($Br_2$) that react with 100 grams of sample under the conditions of the test. Bromine Number is effectively the number of grams of bromine that will react with 100 grams of specimen under the conditions of the test.

In some embodiments, HCl or a component that directly or indirectly supplies protons is added to the reaction mixture. Although not wishing to be limited by theory it is believed that the presence of a Brönsted acid such as HCl greatly enhances the acidity and, thus, the activity of the ionic liquid catalyst system.

Among other factors, the processes provide a surprising new way of making a lubricant base oil or lubricant blendstock that has reduced levels of olefins without hydrogenation or with minimal hydrofinishing. The processes increase the value of the resultant olefin oligomers by increasing the molecular weight of the oligomer and increasing the branching by incorporation of isoparaffin groups into the oligomers' skeletons. These properties can both add significant value to the product particularly when starting with a highly linear hydrocarbon such as Fischer-Tropsch condensate. The product of the present invention can have a combination of highly desirable and novel qualities for a lubricant component or base oil including a very high VI with a very low cloud point while having a fairly wide boiling range.

In some embodiments, the processes use an ionic liquid catalyst to alkylate an oligomerized olefin with an isoparaffin under relatively mild conditions. The alkylation optionally can occur under effectively the same conditions as oligomerization. The finding that alkylation and oligomerization reactions can occur using effectively the same ionic liquid catalyst system and optionally under similar or even the same conditions can be used to make a highly integrated, synergistic process resulting in an alkylated oligomer product having desirable properties. Also in a particular embodiment of the present invention the alkylation and oligomerization reactions can occur concurrently under the same conditions.

The base oil made by the processes of this invention have a kinematic viscosity at 100° C. of 6.9 $mm^2/s$ or greater. In some embodiments, the kinematic viscosity at 100° C. may go as high as up to 20, 25, or 30 $mm^2/s$. The kinematic viscosity can be selected based on the choice of feeds to the process, the set of oligomerization conditions, and the set of alkylation conditions. Additionally, more than one viscosity grade of base oil may be produced by separating the base oil into different viscosity grades by vacuum distillation after it is produced.

In one embodiment, the catalyst system of the present invention is an acidic chloroaluminate ionic liquid system. In one embodiment, the acidic chloroaluminate ionic liquid system is used in the presence of a Brönsted acid. In one embodiment, the Brönsted acid is a halohalide, and one example is HCl.

The oligomerization reaction and the alkylation reaction can be performed concurrently or separately. Advantages of combining the oligomerization and alkylation are lower capital and operating costs. An advantage of the 2 step process (oligomerization followed by alkylation in a separate zone) is that the two separate reaction zones can be optimized independently. Thus the conditions for oligomerization zones can be different than the alkylation zone conditions. Also the ionic liquid catalyst can be different in the different zones. For instance, it may be preferable to make the alkylation zone more acidic than the oligomerization zone. This may involve the use of an entirely different ionic liquid catalyst in the two zones or can include the addition of a Brönsted acid to the alkylation zone.

In one embodiment, the ionic liquid used in the alkylation zone and in the oligomerization zone is the same. This helps save on catalyst costs, potential contamination issues, and provides synergy opportunities in the process.

In some embodiments, the processes produce a base oil product having a very low cloud point and a very high VI. Cloud Point can be determined by ASTM D 2500. VI refers to Viscosity Index, and can be determined by ASTM D 2270. ASTM test methods D 2500 and D D2270 are incorporated by reference herein in their entirety.

In the present application, distillation data was generated for several of the products by SIMDIST. SIMDIST involves the use of ASTM D 6352 or ASTM D 2887 as appropriate. ASTM D 6352 and ASTM D 2887 are incorporated herein by reference in their entirety. Distillation data can also be generated using ASTM D 86 which is incorporated herein by reference in its entirety.

In the present application the terms base oil, lubricant base oil, lubricant blendstock, and lubricant component are used to mean lubricant components that can be used to produce a finished lubricant.

Ionic Liquids

Ionic liquids are a class of compounds made up entirely of ions and are generally liquids at ambient and near ambient temperatures. Often salts which are composed entirely of ions are solids with high melting points, for example, above 450° C. These solids are commonly known as 'molten salts' when heated to above their melting points. Sodium chloride, for example, is a common 'molten salt', with a melting point of 800° C. Ionic liquids differ from 'molten salts', in that they have low melting points, for example, from −100° C. to 200° C. Ionic liquids tend to be liquids over a very wide temperature range, with some having a liquid range of up to 300° C. or higher. Ionic liquids are generally non-volatile, with effectively no vapor pressure. Many are air and water stable, and can be good solvents for a wide variety of inorganic, organic, and polymeric materials.

The properties of ionic liquids can be tailored by varying the cation and anion pairing. Ionic liquids and some of their commercial applications are described, for example, in J. Chem. Tech. Biotechnol, 68:351-356 (1997); J. Phys. Condensed Matter, 5:(supp 34B):B99-B106 (1993); Chemical and Engineering News, Mar. 30, 1998, 32-37; J. Mater. Chem., *:2627-2636 (1998); and Chem. Rev., 99:2071-2084 (1999), the contents of which are hereby incorporated by reference.

Many ionic liquids are amine-based. Among the most common ionic liquids are those formed by reacting a nitrogen-containing heterocyclic ring (cyclic amines), preferably nitrogen-containing aromatic rings (aromatic amines), with an alkylating agent (for example, an alkyl halide) to form a quaternary ammonium salt, followed by ion exchange with Lewis acids or halide salts, or by anionic metathesis reactions with the appropriate anion sources to introduce the desired counter anionic to form ionic liquids. Examples of suitable heteroaromatic rings include pyridine and its derivatives, imidazole and its derivatives, and pyrrole and its derivatives. These rings can be alkylated with varying alkylating agents to incorporate a broad range of alkyl groups on the nitrogen including straight, branched or cyclic $C_{1-20}$ alkyl group, but preferably $C_{1-12}$ alkyl groups since alkyl groups larger than $C_1$-$C_{12}$ may produce undesirable solid products rather than ionic liquids. Pyridinium and imidazolium-based ionic liquids are perhaps the most commonly used ionic liquids. Other amine-based ionic liquids including cyclic and non-cyclic quaternary ammonium salts are frequently used. Phosphonium and sulphonium-based ionic liquids have also been used.

Counter anions which have been used include chloroaluminate, bromoaluminate, gallium chloride, tetrafluoroborate, tetrachloroborate, hexafluorophosphate, nitrate, trifluoromethane sulfonate, methylsulfonate, p-toluenesulfonate, hexafluoroantimonate, hexafluoroarsenate, tetrachloroaluminate, tetrabromoaluminate, perchlorate, hydroxide anion, copper dichloride anion, iron trichloride anion, antimony hexafluoride, copper dichloride anion, zinc trichloride anion, as well as various lanthanum, potassium, lithium, nickel, cobalt, manganese, and other metal ions. The ionic liquids used in the present invention are preferably acidic haloaluminates and preferably chloroaluminates.

The organic cations in the ionic liquid can be selected from the group consisting of pyridinium-based and imidazolium-based cations. Cations that have been found to be particularly useful in the processes include pyridinium-based cations.

In one embodiment the ionic liquids that can be used in the process include acidic chloroaluminate ionic liquids. Examples of ionic liquids that can be used are acidic pyridinium chloroaluminates. Other ionic liquids useful in the process are alkyl-pyridinium chloroaluminates. In one embodiment the ionic liquids useful in the process are alkyl-pyridinium chloroaluminates having a single linear alkyl group of 2 to 6 carbon atoms in length. One particular ionic liquid that has proven effective is 1-butyl-pyridinium chloroaluminate.

In one embodiment, 1-butyl-pyridinium chloroaluminate is used in the presence of a Brönsted acid. Not to be limited by theory, the Brönsted acid acts as a promoter or co-catalyst. Examples of Brönsted acids are Sulfuric acid, HCl, HBr, HF, Phosphoric acid, HI, etc. Other protic acids or species that directly or indirectly aid in supplying protons may also be used as Brönsted acids or in place of Brönsted acids.

The Feeds

In the processes, one of the important feedstocks is an olefin feed comprising a reactive olefinic hydrocarbon. The reactive olefinic hydrocarbon provides the reactive site for the oligomerization reaction as well as the alkylation reaction. The olefinic hydrocarbon can be a fairly pure olefinic hydrocarbon cut or can be a mixture of hydrocarbons having different chain lengths and thus a wide boiling range. The olefinic hydrocarbon can be terminal olefin (an alpha olefin) or can be internal olefin (internal double bond). The olefinic hydrocarbon chain can be either straight chain or branched or a mixture of both. The olefin feed can include unreactive diluents such as normal paraffins.

The olefin feed is from a Fischer-Tropsch condensate. Fischer-Tropsch condensate is the product from a Fischer-Tropsch reactor that has carbon numbers of C21 and less. Fischer-Tropsch condensate may comprise olefins in the range of C2 to C21. In one embodiment, the Fischer-Tropsch condensate comprises olefins in the range of C4 to C21. In another embodiment, an olefin fraction in the olefin feed from a Fischer-Tropsch condensate comprises greater than 50 wt % C4+ olefins, greater than 70 wt % C4+ olefins, or even greater than 90 wt % C4+ olefins.

In one embodiment, the Fischer-Tropsch condensate has at least 10 wt % olefins. Since iron-based catalysts will generally yield a higher percentage of olefins and branched hydrocarbons in the Fischer-Tropsch product than a cobalt-based catalyst, an iron-based Fischer-Tropsch catalyst may represent another preferred embodiment of the present invention. In other embodiments, the Fischer-Tropsch condensate will have at least 20 wt % olefins, at least 40 wt % olefins, or at least 50 wt % olefins. The wt % olefins refers to the weight percent of the olefin feed which contains at least one unsaturated carbon to carbon bond in the molecule.

In an embodiment of the present invention, some or all of the olefin feed to the process comprises thermally cracked hydrocarbons, such as thermally cracked Fischer-Tropsch wax or condensate from a Fischer-Tropsch (FT) process. A process for making olefins by cracking FT products is disclosed in U.S. Pat. No. 6,497,812 which is incorporated herein by reference in its entirety.

In the Fischer-Tropsch synthesis process, liquid and gaseous hydrocarbons are formed by contacting a synthesis gas (syngas) comprising a mixture of hydrogen and carbon monoxide with a Fischer-Tropsch catalyst under suitable temperature and pressure reactive conditions. The Fischer-Tropsch reaction is typically conducted at temperatures of from about 300° F. to about 700° F. (149° C. to 371° C.) preferably from about 400° F. to about 550° F. (204° C. to 228° C.); pressures of from about 10 psia to about 600 psia (0.7 bars to 41 bars), preferably 30 psia to 300 psia (2 bars to 21 bars), and catalyst space velocities of from about 100 cc/g/hr. to about 10,000 cc/g/hr., preferably 300 cc/g/hr. to 3,000 cc/g/hr.

The products from the Fischer-Tropsch synthesis may range from $C_1$ to $C_{200}$ plus hydrocarbons with a majority, by weight, in the $C_5$-$C_{100}$ plus range. The reaction can be conducted in a variety of reactor types, for example, fixed bed reactors containing one or more catalyst beds, slurry reactors, fluidized bed reactors, or a combination of different type reactors. Such reaction processes and reactors are well known and documented in the literature. Slurry Fischer-Tropsch processes, which is a preferred process in the practice of the invention, utilize superior heat (and mass) transfer characteristics for the strongly exothermic synthesis reaction and are able to produce relatively high molecular weight, paraffinic hydrocarbons when using a cobalt catalyst. In a slurry process, a syngas comprising a mixture of hydrogen and carbon monoxide is bubbled up in the reactor as a third phase through a slurry which comprises a particulate Fischer-Tropsch type hydrocarbon synthesis catalyst dispersed and suspended in a slurry liquid comprising hydrocarbon products of the synthesis reaction which are liquid at the reaction conditions. The mole ratio of the hydrogen to the carbon monoxide may broadly range from about 0.5 to about 4, but is more typically within the range of from about 0.7 to about 2.75 and preferably from about 0.7 to about 2.5. A particularly preferred Fischer-Tropsch process is taught in EP 0609079, also completely incorporated herein by reference for all purposes.

Suitable Fischer-Tropsch catalysts comprise one or more Group VIII catalytic metals such as Fe, Ni, Co, Ru and Re, with cobalt generally being one preferred embodiment. Additionally, a suitable catalyst may contain a promoter. Thus, in one embodiment, the Fischer-Tropsch catalyst will comprise effective amounts of cobalt and one or more of Re, Ru, Pt, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as $ThO_2$, $La_2O_3$, MgO, $K_2O$ and $TiO_2$, promoters such as $ZrO_2$, noble metals (Pt, Pd, Ru, Rh, Os, Ir), coinage metals (Cu, Ag, Au), and other transition metals such as Fe, Mn, Ni, and Re. Suitable support materials include alumina, silica, magnesia and titania or mixtures thereof. Preferred supports for cobalt containing catalysts comprise titania. Useful catalysts and their preparation are known and illustrated in U.S. Pat. No. 4,568,663, which is intended to be illustrative but non-limiting relative to catalyst selection.

In the process of the present invention, another important feedstock is an isoparaffin. The simplest isoparaffin is isobutane. Isopentanes, isohexanes, isoheptanes, and other higher isoparaffins are also useable in the process of the present invention. Economics and availability are the main drivers of the isoparaffins selection. Lighter isoparaffins tend to be less expensive and more available due to their low gasoline blend value (due to their relatively high vapor pressure). Mixtures of light isoparaffins can also be used in the present invention. Mixtures such as $C_4$-$C_5$ isoparaffins can be used and may be advantaged because of reduced separation costs. The isoparaffins feed stream may also contain diluents such as normal paraffins. This can be a cost savings, by reducing the cost of separating isoparaffins from close boiling paraffins. Normal paraffins will tend to be unreactive diluents in the process of the present invention.

In an optional embodiment the resultant alkylated oligomer made in the present invention can be hydrogenated to further decrease the concentration of olefins and thus the Bromine Number. After hydrogenation, the lubricant component or base oil has a Bromine Number of less than 0.8, preferably less than 0.5, more preferably less than 0.3, still more preferably less than 0.2.

Alkylation conditions for the processes include a temperature of from about 15 to about 200° C., from about 20 to about 150° C., from about 25 to about 100, or from about 50 to 100° C.

Oligomerization conditions for the processes include a temperature of from about 0 to about 150° C., from about 10 to about 100° C., or from about 0 to about 50° C.

As discussed elsewhere in the present application the oligomerization and the alkylation can occur separately (in separate optimized zones) or can occur concurrently. In the embodiment where the alkylation and oligomerization occur concurrently, optimum conditions for either reaction may have to be compromised. However, we have found that the conditions can be adjusted to achieve both substantial oligomerization and alkylation and resulting in a valuable lubricant base oil or blendstock.

In summary, some of the potential benefits of the process and composition of the present invention include:

- Reduced capital cost for hydrotreating/hydrofinishing
- Lower operating cost due to reduced hydrogen and extensive hydrogenation requirements
- Potential use of the same ionic liquid catalyst for oligomerization and alkylation steps
- Improved branching characteristics of the product
- Increased overall molecular weight of the product
- Incorporation of low cost feed (isoparaffins) to increase liquid yield of high value distillate fuel or lubricant components
- Production of a base oil or lubricant component having unique, high value properties
- Upgrading of a lower value olefin feed from a Fischer-Tropsch condensate.

For the purposes of this specification and appended claims, unless otherwise indicated, all numbers expressing quantities, percentages or proportions, and other numerical values used in the specification and claims, are to be understood as being modified in all instances by the term "about." Furthermore, all ranges disclosed herein are inclusive of the endpoints and are independently combinable. Whenever a numerical range with a lower limit and an upper limit are disclosed, any number falling within the range is also specifically disclosed.

Any term, abbreviation or shorthand not defined is understood to have the ordinary meaning used by a person skilled in the art at the time the application is filed. The singular forms "a," "an," and "the," include plural references unless expressly and unequivocally limited to one instance.

All of the publications, patents and patent applications cited in this application are herein incorporated by reference in their entirety to the same extent as if the disclosure of each individual publication, patent application or patent was specifically and individually indicated to be incorporated by reference in its entirety.

This written description uses examples to disclose the invention, including the best mode, and also to enable any person skilled in the art to make and use the invention. Many modifications of the exemplary embodiments of the invention disclosed above will readily occur to those skilled in the art. Accordingly, the invention is to be construed as including all structure and methods that fall within the scope of the appended claims.

EXAMPLES

Example 1

Preparation of Fresh 1-butyl-pyridinium chloroaluminate Ionic Liquid 1-butyl-pyridinium chloroaluminate is a room temperature ionic liquid prepared by mixing neat 1-butyl-pyridinium chloride (a solid) with neat solid aluminum trichloride in an inert atmosphere. The syntheses of 1-butyl-pyridinium chloride and the corresponding 1-butyl-pyridinium chloroaluminate are described below. In a 2-L Teflon-lined autoclave, 400 gm (5.05 mol.) anhydrous pyridine (99.9% pure purchased from Aldrich) were mixed with 650 gm (7 mol.) 1-chlorobutane (99.5% pure purchased from Aldrich). The neat mixture was sealed and let to stir at 125° C. under autogenic pressure over night. After cooling off the autoclave and venting it, the reaction mix was diluted and dissolved in chloroform and transferred to a three liter round bottom flask. Concentration of the reaction mixture at reduced pressure on a rotary evaporator (in a hot water bath) to remove excess chloride, unreacted pyridine and the chloroform solvent gave a tan solid product. Purification of the product was done by dissolving the obtained solids in hot acetone and precipitating the pure product through cooling and addition of diethyl ether. Filtering and drying under vacuum and heat on a rotary evaporator gave 750 gm (88% yields) of the desired product as an off-white shinny solid. $^{1}$H-NMR and $^{13}$C-NMR were ideal for the desired 1-butyl-pyridinium chloride and no presence of impurities was observed by NMR analysis.

1-Butyl-pyridinium chloroaluminate was prepared by slowly mixing dried 1-butyl-pyridinium chloride and anhydrous aluminum chloride ($AlCl_3$) according to the following procedure. The 1-butyl-pyridinium chloride (prepared as described above) was dried under vacuum at 80° C. for 48 hours to get rid of residual water (1-butyl-pyridinium chloride is hydroscopic and readily absorbs water from exposure to air). Five hundred grams (2.91 mol.) of the dried 1-butyl-pyridinium chloride were transferred to a 2-Liter beaker in a nitrogen atmosphere in a glove box. Then, 777.4 gm (5.83 mol.) of anhydrous powdered $AlCl_3$ (99.99% from Aldrich) were added in small portions (while stirring) to control the temperature of the highly exothermic reaction. Once all the $AlCl_3$ was added, the resulting amber-looking liquid was left to gently stir overnight in the glove box. The liquid was then filtered to remove any un-dissolved $AlCl_3$. The resulting acidic 1-butyl-pyridinium chloroaluminate was used as the catalyst for the Examples in the Present Application.

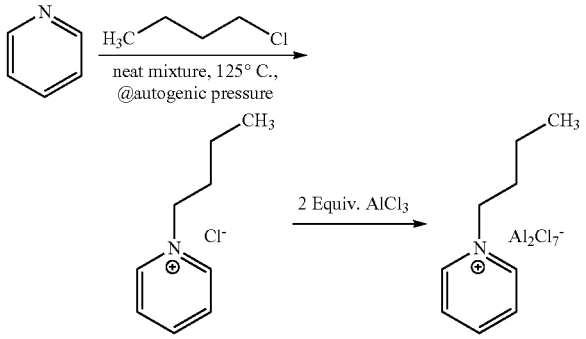

Example 2

Oligomerization of 1-decene

One process for making high quality oils is by oligomerization of olefins followed by a separate step of alkylation with an isoparaffin. Olefin oligomers exhibit good physical lubricating properties. However, introducing short chain branching in the oligomers enhances the properties of the final products. Introducing the branching can be done by alkylation of the oligomers with isoparaffins. Alkylation of the oligomeric products is also a route to reducing the olefinicity of the oligomers and, hence, producing chemically and thermally more stable oligomers. The process is exemplified by alkylation of 1-decene oligomers (described below).

Oligomerization of 1-decene and alkylation of the oligomer were done according to the procedures described below. In a 300 cc autoclave equipped with an overhead stirrer, 100 gm of 1-decene was mixed in with 20 gm of 1-methyl-tributyl ammonium chloroaluminate. A small amount of HCl (0.35 gm) was introduced to the mix as a promoter and the reaction mix was heated to 50° C. with vigorous stirring for 1 hr. Then, the stirring was stopped and the reaction was cooled down to room temperature and let to settle. The organic layer (insoluble in the ionic liquid) was decanted off and washed with 0.1N KOH. The organic layer was separated and dried over anhydrous $MgSO_4$. The colorless oily substance was analyzed by SIMDIST. The oligomeric product has a Bromine Number of 7.9. Table 1 below shows the SIMDIST analysis of the oligomerization products.

Example 3

Alkylations of 1-decene Oligomers

The oligomers of 1-decene made as described in example 2 were alkylated with isobutane in 1-butyl-pyridinium chloroaluminate and in methyl-tributyl ammonium chloroaluminate (TBMA) ionic liquids according to the procedures described below. In a 300 cc autoclave fitted with an overhead stirrer, 26 gm of the oligomer and 102 gm of isobutane were added to 21 gm of methyl-tributyl-ammonium chloroaluminate ionic liquid. To this mixture, 0.3 gm of HCl gas was added and the reaction was heated to 50° C. for 1 hr while stirring at >1000 rpm. Then the reaction was stopped and the products were collected in a similar procedure as described above for the oligomerization reaction. The collected products, colorless oils, have a Bromine Number of 3.2. Table 1 shows the SIMDIST analysis of the oligomer alkylation products.

Alkylation of the oligomer was repeated using the same procedure described above, but 1-butyl-pyridinium chloroaluminate was used in place of methyl-tributyl-ammonium chloroaluminate. Alkylation of the oligomer in 1-butyl-pyridinium chloroaluminate gave a product with a bromine index of 2.7. The SIMDIST data is shown in Table 1.

TABLE 1

| SIMDIST TBP (WT %) | 1-Decene Oligomers ° F. | 1-Decene oligomers Alkylation in 1-butyl-pyridinium chloroaluminate | 1-Decene oligomers alkylation in TBMA |
|---|---|---|---|
| TBP@0.5 | 330 | 298 | 296 |
| TBP@5 | 608 | 341 | 350 |
| TBP@10 | 764 | 574 | 541 |
| TBP@15 | 789 | 644 | 630 |
| TBP@20 | 856 | 780 | 756 |
| TBP@30 | 944 | 876 | 854 |
| TBP@40 | 1018 | 970 | 960 |
| TBP@50 | 1053 | 1051 | 1050 |
| TBP@60 | 1140 | 1114 | 1118 |
| TBP@70 | 1192 | 1167 | 1173 |
| TBP@80 | 1250 | 1213 | 1220 |
| TBP@90 | 1311 | 1263 | 1268 |
| TBP@95 | 1340 | 1287 | 1291 |
| TBP@99.5 | 1371 | 1312 | 1315 |

Example 4

Oliqomerization of 1-decene in Ionic Liquids in the Presence of Iso-Butane

Oligomerization of 1-decene was carried out in acidic 1-butyl-pyridinium chloroaluminate in the presence of 10 mole % of isobutane. The reaction was done in the presence of HCl as a promoter. The procedure below describes, in general, the process. To 42 gm of 1-butyl-pyridinium chloroaluminate in a 300 cc autoclave fitted to an overhead stirrer, 101 gm of 1-decene and 4.6 gm of isobutane were added and the autoclave was sealed. Then 0.4 gm of HCl was introduced and the stirring started. The reaction was heated to 50° C. The reaction was exothermic and the temperature quickly jumped to 88° C. The temperature in few minutes went back down to 44° C. and was brought up to 50° C. and the reaction was vigorously stirred at about 1200 rpm for an hour at the autogenic pressure (~atmospheric pressure in this case). Then, the stirring was stopped and the reaction was cooled to room temperature. The contents were allowed to settle and the organic layer (immiscible in the ionic liquid) was decanted off and washed with 0.1N KOH aqueous solution. The colorless oil was analyzed with simulated distillation and bromine analysis. The Bromine Number was 2.6. The Bromine Number is much less than that usually observed for the 1-decene oligomerization in the absence of isobutane. The Bromine Number for 1-decene oligomerization in the absence of $iC_4$ is in the range of 7.5-7.9 based on the catalyst, contact time and catalyst amounts used in the oligomerization reaction. The Simulated Distillation data is shown in Table 3.

The Simulated Distillation data in Tables 1 and 3 show that alkylations of the already made 1-decene oligomers with isobutane and the simultaneous oligomerization/alkylation of 1-decene lead to fairly comparable products. The overall outcome of the two operations is amazingly close in the products boiling ranges and olefinic contents as indicated by bromine numbers shown in Table 2.

Table 2 compares the Bromine Numbers of the starting 1-decene, 1-decene, oligomerization products in the presence of $iC_4$, $_1$-decene oligomerization products without $iC_4$, and the alkylation products of 1-decene oligomers with excess $iC_4$.

TABLE 2

| Material | 1-Decene | Oligomerization-alkylation of 1-Decene with 10 mol % $iC_4$ | Oligomerization Products of 1-Decene/No $iC_4$ | Alkylated 1-decene oligomers |
|---|---|---|---|---|
| Bromine Number | 114 | 2.6 | 7.9 | 2.8 |

The data above suggests that the chemistry can be done by either alkylating the oligomers in situ (where isoparaffins are introduced into the oligomerization reactor) or in consecutive steps to oligomerization of an alpha olefin. In both processes, the yielded products are close in their properties. In the simultaneous oligomerization-alkylation scheme, the desired alkylated oligomeric products can be made in one single step and, thus, can be an economically advantageous process. However, the two step process with two separate reaction zones where each can be optimized independently, provides greater chances for tailoring and tuning the conditions to make products with particularly desired properties.

Example 5

Oligomerization of 1-decene in Ionic Liquids in the Presence of Varying Iso-Butane Concentrations Oligomerization of 1-decene was carried out in acidic 1-butyl-pyridinium chloroaluminate in the presence of varying mole % of isobutane. The reaction was done in the presence of HCl as a promoter (co-catalyst). The procedure below describes, in general, the process. To 42 gm of 1-butyl-pyridinium chloroaluminate in a 300 cc autoclave fitted to an overhead stirrer, 101 gm of 1-decene and 4.6 gm of isobutane were added and the autoclave was sealed. Then 0.2-0.5 gm of HCl was introduced into the reactor, and then, started the stirring. The reaction is exothermic and the temperature quickly jumped to 88° C. The temperature dropped down quickly to the mid 40s and was brought up to 50° C. and kept at around 50° C. for the remainder of the reaction time. The reaction was vigorously stirred for about an hour at the autogenic pressure. The stirring was stopped, and the reaction was cooled to room temperature. The contents were allowed to settle and the organic layer (immiscible in the ionic liquid) was decanted off and washed with 0.1N KOH aqueous solution. The recovered oils were characterized with simulated distillation, bromine analysis, viscosity, viscosity indices, and pour and cloud points.

Table 3, below, show the properties of the resulting oils of different 1-decene/isobutane ratios. All the reactions were run for approximately 1 hr at 50° C. in the presence of 20 gm of ionic liquid catalyst.

TABLE 3

| n | $C_{10}^{=}$/ iC4 = 0.8 | $C_{10}^{=}$/ $iC_4$ = 1 | $C_{10}^{=}$/ $iC_4$ = 4 | $C_{10}^{=}$/ $iC_4$ = 5.5 | $C_{10}^{=}$/ $iC_4$ = 9 |
|---|---|---|---|---|---|
| TBP @0.5 | 301 | 311 | 322 | 329 | 331 |
| TBP @5 | 340 | 382 | 539 | 605 | 611 |
| TBP @10 | 440 | 453 | 663 | 746 | 775 |
| TBP @20 | 612 | 683 | 792 | 836 | 896 |
| TBP @30 | 798 | 842 | 894 | 928 | 986 |
| TBP @40 | 931 | 970 | 963 | 999 | 1054 |
| TBP @50 | 1031 | 1041 | 1007 | 1059 | 1105 |
| TBP @60 | 1098 | 1099 | 1067 | 1107 | 1148 |
| TBP @70 | 1155 | 1154 | 1120 | 1154 | 1187 |
| TBP @80 | 1206 | 1205 | 1176 | 1200 | 1228 |
| TBP @90 | 1258 | 1260 | 1242 | 1252 | 1278 |
| TBP @95 | 1284 | 1290 | 1281 | 1282 | 1305 |
| TBP @99.5 | 1311 | 1326 | 1324 | 1313 | 1335 |

The data shown in Table 3 indicates that the amount of isobutane added to the reaction does influence the boiling range of the produced oils. As shown in Table 3, there are more products in the lower boiling cuts when higher concentrations of isobutane are used in the reaction. This indicates that more alkylation is taking part directly with 1-decene and 1-decene dimers rather than with higher oligomers when higher isobutane concentrations are present in the reaction zone. When more isobutane is present more alkylation can occur, and 1-decene alkylation with $iC_4$ to make $C_{14}$ and 1-decene dimer alkylation to make $C_{24}$ will be more prevalent than at lower concentrations of isobutane. Therefore, the degree of branching and oligomerization can be tailored by the choice of olefins, isoparaffins, olefin/isoparaffin ratios, contact time and the reaction conditions.

The alkylated oligomers will no longer take part in further oligomerization due to "capping" off of their olefinic sites, and the final oligomeric chain will be shorter perhaps than the normal oligomeric products, but with more branching. While the oligomerization pathway is the dominant mechanism, it is very clear that the alkylation of 1-decene and its oligomers with isobutane does take part in the chemistry.

Table 4, below, compares some physical properties of the products obtained from the reactions of Table 3.

TABLE 4

| | $C10^{=}$/ $iC_4$ = 0.8 | $C10^{=}$/ $iC_4$ = 1 | $C10^{=}$/ $iC_4$ = 4 | $C10^{=}$/ $iC_4$ = 5.5 | $C10^{=}$/ $iC_4$ = 9 |
|---|---|---|---|---|---|
| VI | 145 | 171 | 148 | 190 | 150 |
| Vis@100 | 9.84 | 7.507 | 9.73 | 7.27 | 11.14 |
| VIS@40 | 61.27 | 37.7 | 59.63 | 33.5 | 70.21 |
| Pour Point | −42 | −42 | −44 | −44 | −52 |
| Cloud Point | −63 | −64 | −66 | −69 | −28 |
| Bromine Number | 3.1 | 0.79 | 2.2 | 3.8 | 6.1 |

The oligomerization/alkylation run @ 1-decene/$iC_4$ ratio of 5.5 was repeated several times at the same feed ratios and conditions. The viscosity @100° C. in the repeated samples ranged from 6.9-11.2 cSt. The VI ranged from 156-172. All the repeated samples contained low boiling cuts (below 775° F.) ranging from 10%-15%. The low boiling cut appears to influence the VI.

The Bromine Numbers shown in Table 4 are much less than usually observed for the 1-decene oligomerization in the absence of isobutane. The Bromine Number for 1-decene oligomerization in the absence of $iC_4$ is in the range of 7.5-7.9 based on the catalyst, contact time and catalyst amounts used in the oligomerization reaction. Table 5, below, compares the Bromine Number analysis of 1-decene, simultaneous oligomerization and alkylation of 1-decene, 1-decene oligomerization only products, and the alkylated oligomers (oligomerization followed by alkylation). By looking at these values, one can see the role of the incorporation of isobutane on the olefinicity of the final products.

TABLE 5

| Material | 1-Decene | Oligomerization with 10 mol % $iC_4$, (20 mol % $iC_4$) | 1-Decene Oligomerization | Alkylated 1-decene oligomers with $iC_4$ |
|---|---|---|---|---|
| Bromine Number | 114 | 6.1, (2.2) | 7.9 | 2.8 |

Example 6

Oliqomerization of a Mixture of Alpha Olefins in the Presence of Iso-Butane

A 1:1:1 mixture of 1-hexene:1-octene:1-decene was oligomerized in the presence of isobutane at the reaction conditions described earlier for oligomerization of 1-decene in the presence of isobutane (100 gm olefins, 20 gm IL catalyst, 0.25 gm HCl as co-catalyst, 50° C., autogenic pressure, 1 hr). The products were separated from the IL catalyst, and the IL layer was rinsed with hexane, which was decanted off and added to the products. The products and the hexane wash were treated with 0.1N NaOH to remove any residual $AlCl_3$. The organic layers were collected and dried over anhydrous $MgSO_4$. Concentration (on a rotary evaporator at reduced pressure, in a water bath at ~70° C.) gave the oligomeric product as viscous yellow oils. Table 6 below shows the Simulated Distillation, viscosity, and pour point, cloud point, and bromine number data of the alkylated oligomeric products of the olefinic mixture in the presence of isobutane.

TABLE 6

| | Oligomers of $C_6^{=}$, $C_8^{=}$, $C_{10}^{=}$ W/$iC_4$ ° F. |
|---|---|
| SIMDIST TBP (WT %), | |
| TBP @0.5 | 313 |
| TBP @5 | 450 |

TABLE 6-continued

| | Oligomers of $C_6^=$, $C_8^=$, $C_{10}^=$ W/i$C_4$ ° F. |
|---|---|
| TBP @10 | 599 |
| TBP @15 | 734 |
| TBP @20 | 831 |
| TBP @30 | 953 |
| TBP @40 | 1033 |
| TBP @50 | 1096 |
| TBP @60 | 1157 |
| TBP @70 | 1220 |
| TBP @80 | 1284 |
| TBP @90 | 1332 |
| TBP @95 | 1357 |
| TBP @99.5 | 1384 |
| Physical Properties: | |
| VI | 140 |
| VIS@100° C. | 7.34 CST |
| VIS@40° C. | 42 CST |
| Pour Point | −54° C. |
| Cloud Point | <−52° C. |
| Bromine Number | 3.1 |

As shown in the data above, high quality oils with desirable lubricating properties can be made by either concurrent olefin oligomerization and alkylation, or by oligomerization of the appropriate olefins followed by alkylation of the oligomeric products. Regardless of the process, the oils produced in both processes appear to be close in their boiling ranges, olefinicity and physical properties such as viscosity indices, kinematic viscosities, pour points and cloud points. Both process lead to oils with appreciable concentrations of branched paraffins formed by capping (alkylating) olefins and their oligomers and low olefin concentrations.

Example 7

Fischer-Tropsch Condensate

A sample of Fischer-Tropsch condensate, taken directly from a Fischer-Tropsch reactor without further processing, was analyzed by gas chromatography and determined to have a high proportion of C4+ olefins.

The distribution of the olefins in the Fischer-Tropsch condensate are summarized below in Table 7:

TABLE 7

| Carbon Number | Wt % of Olefins in the Condensate |
|---|---|
| C2 | 0 |
| C3 | 0.1088 |
| C4 | 0.2468 |
| C5 | 0.4791 |
| C6 | 0.7839 |
| C7 | 5.9882 |
| C8 | 1.3646 |
| C9 | 2.2066 |
| C10 | 3.26636 |
| C11 | 3.6220 |
| C12 | 1.1178 |
| C13 | 3.7018 |
| C14 | 4.2970 |
| C15 | 5.8358 |

TABLE 7-continued

| Carbon Number | Wt % of Olefins in the Condensate |
|---|---|
| C16 | 8.9279 |
| C17 | 11.4829 |
| C18 | 15.0976 |
| C19 | 11.8966 |
| C20 | 10.5901 |
| C21 | 8.9860 |
| Total | 100 |

The Fischer-Tropsch condensate comprises olefins in the range of C3-C21, and also in the range of C4-C21. The high wt % of higher carbon number, such as C10+, olefins is a desired property to make higher viscosity base oils. The wt % olefins in this sample were greater than 99.8 wt % C4+, greater than 99.5 wt % C5+, greater than 99 wt % C6+, greater than 98 wt % C7+, greater than 92 wt % C8+, greater than 91 wt % C9+, and greater than 88 wt % C10+. This condensate would provide a useful range of olefins for making base oils.

What is claimed is:

1. A process for making a base oil, comprising: contacting an olefin feed from a Fischer-Tropsch condensate with an isoparaffin, an acidic chloroaluminate ionic liquid catalyst which is an alkyl-pyridinium chloroaluminate having a single linear alkyl group of 2 to 6 carbon atoms in length, and a Bronsted acid which is derived at least in part from an alkyl halide; whereby a base oil is produced by concurrent oligomerization and alkylation of the olefin feed, wherein the base oil has:

i. a kinematic viscosity at 100 degrees C. of 6.9 $mm^2/s$ or greater, ii. a VI of at least 134, and iii. a Bromine Number of less than 4.

2. The process of claim 1, wherein the base oil has a cloud point less than −50 degrees C.

3. The process of claim 1, wherein the olefin feed from the Fischer-Tropsch condensate has an olefin fraction comprising greater than 50 wt % C4+ olefins.

4. The process of claim 3, wherein the olefin feed from the Fischer-Tropsch condensate has an olefin fraction comprising greater than 70 wt % C4+ olefins.

5. The process of claim 4, wherein the olefin feed from the Fischer-Tropsch condensate has an olefin fraction comprising greater than 90 wt % C4+ olefins.

6. The process of claim 5, wherein the olefin feed from the Fischer-Tropsch condensate has an olefin fraction comprising greater than 92 wt % C8+.

7. The process of claim 1, wherein the acidic chloroaluminate ionic liquid catalyst is 1-butyl-pyridinium chloroaluminate.

8. The process of claim 1, wherein the isoparaffin is selected from the group consisting of isobutane, isopentanes, isohexanes, isoheptanes, and mixtures thereof.

9. The process of claim 8, wherein the isoparaffin is isobutane.

10. The process of claim 8, wherein the isoparaffin is a mixture of $C_4$-$C_5$ isoparaffins.

* * * * *